United States Patent [19]

Bresson et al.

[11] Patent Number: 4,601,818

[45] Date of Patent: Jul. 22, 1986

[54] ORE FLOTATION

[75] Inventors: Clarence R. Bresson; Kenneth B. Kimble, both of Bartlesville, Okla.

[73] Assignee: Phillips Petroleum Company, Bartlesville, Okla.

[21] Appl. No.: 480,205

[22] Filed: Mar. 30, 1983

[51] Int. Cl.[4] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,652,060 | 12/1927 | Smith | 209/167 |
| 1,780,000 | 10/1930 | Bolton | 209/166 |
| 1,833,740 | 11/1931 | Derby et al. | 209/166 |
| 1,858,007 | 5/1932 | Falconer et al. | 209/166 |
| 2,203,740 | 6/1940 | Ott | 209/166 |
| 2,600,737 | 6/1952 | Crouch et al. | 260/455 |
| 4,022,686 | 5/1977 | Arakatsu et al. | 209/166 |
| 4,211,644 | 7/1980 | Wiechers | 209/166 |
| 4,316,797 | 2/1982 | Parlman | 209/166 |
| 4,341,715 | 7/1982 | Parlman et al. | 260/455 B |

*Primary Examiner*—Bernard Nozick

*Attorney, Agent, or Firm*—French & Doescher

[57] ABSTRACT

Mercaptobenzothiazoles are usually employed together with hydrocarbyl trithiocarbonate in flotation processes for the recovery of copper values from an ore containing same.

17 Claims, No Drawings

ORE FLOTATION

BACKGROUND OF THE INVENTION

The present invention relates to ore flotation. In another aspect, the invention relates to a mineral collector for use in ore flotation. In another aspect, the invention relates to an improved ore flotation process.

Froth flotation is a process for recovering and concentrating minerals from ores. In a froth flotation process, the ore is crushed and wet ground to obtain a pulp. Additives such as mineral flotation or collecting agents, frothing agents, suppressants, stabilizers, and the like are added to the pulp to assist separating valuable minerals from the undesired gangue portions of the ore. The pulp is then aerated to produce a froth at the surface. The minerals which adhere to the bubbles or froth are skimmed or otherwise removed and a mineral-bearing froth is collected and further processed to obtain the desired minerals. Typical mineral flotation collectors include xanthates, amines, alkyl sulfates, arene sulfonates, dithiocarbamates, dithiophosphates, and thiols.

OBJECTS OF THE INVENTION

It is an object of this invention to provide a composition of matter useful to increase the productivity of an ore flotation process.

SUMMARY OF THE INVENTION

In one aspect of the present invention, there is provided a composition of matter comprising a blend of a mercaptobenzothiazole and a hydrocarbyl trithiocarbonate.

In another aspect of the invention, there is provided an improvement to a process for the recovery of copper values from an ore containing copper, wherein the values are recovered in a froth from an aqueous slurry containing the ore. The improvement comprises employing together as mineral collectors in the aqueous slurry, a mercaptobenzothiazole and a hydrocarbyl trithiocarbonate by separate addition or as a premixed blend.

In yet another aspect of the present invention, in a process for the recovery of copper values from an ore containing same, wherein the values are recovered in a froth from an aqueous slurry containing the ore, wherein 2-mercaptobenzothiazole is employed as a mineral collector in the aqueous slurry to increase the copper values in the froth, the improvement is provided comprising employing together with the 2-mercaptobenzothiazole a trithiocarbonate which is represented by the formula:

$$R-S-\overset{\overset{\displaystyle S}{\|}}{C}-S-M$$

where R represents hydrocarbyl radical containing from 2 to about 20 carbon atoms and M represents ammonium cation or Group IA metal, said 2-mercaptobenzothiazole and trithiocarbonate being present at a ratio and in a combined concentration sufficient to result in higher copper values in the froth than would be the case where the 2-mercaptobenzothiazole or the hydrocarbyl trithiocarbonate was used without the other at that concentration.

DETAILED DESCRIPTION OF THE INVENTION

In accordance with the present invention, there is provided a composition of matter which can be characterized as a blend of a mercaptobenzothiazole and a hydrocarbyl trithiocarbonate. The mercaptobenzothiazole is represented by the formula:

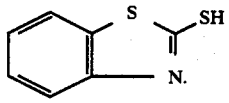

The hydrocarbyl trithiocarbonate is preferably one represented by the formula:

$$R-S-\overset{\overset{\displaystyle S}{\|}}{C}-S-M$$

where R represents a hydrocarbyl radical containing from 2 to about 20 carbon atoms, preferably being alkyl or alkenyl, and more preferably containing from 2 to about 8 carbon atoms, even more preferably alkyl of from 2–5 carbon atoms, and most preferably n-butyl since sodium n-butyl trithiocarbonate was tested with good results. M generally can be selected from the Group consisting of a Group IA metal and an ammonium cation. By Group IA metals is meant lithium, sodium, potassium, rubidium, and cesium. More preferably, M is selected from the Group consisting of sodium and potassium. Most preferably, M represents sodium since sodium n-butyl trithiocarbonate has been used in the blend with good results.

Generally, most any blend which contains the hydrocarbyl trithiocarbonate and the mercaptobenzothiazole together will provide some benefit. However, blends which contain them together at a weight ratio which is in the range from about 20:80 to about 80:20 are preferred. However, since the mercaptobenzothiazole and a hydrocarbyl trithiocarbonate can be added to a ore flotation process alone or separately, it should be borne in mind that composition embodying the invention may contain the blend at very dilute concentrations. Where the mercaptobenzothiazole and the hydrocarbyl trithiocarbonate are preblended prior to adding them simultaneously to an ore flotation process, the inventive compositions will generally contain in the range of from about 0.1 to 50 parts by weight of blend per 100 parts by weight of water.

In another aspect of the present invention, the above described blend is employed as a mineral collector for the recovery of copper values from an ore containing copper, or a concentrate therefrom. The invention has special applicability in a froth flotation process where the mineral values are recovered in a froth from an aqueous slurry containing the ore. Examples of suitable copper bearing ores which can be usefully processed in accordance with the invention are given in the following table.

TABLE

| | |
|---|---|
| Chalcocite, | $Cu_2S$ |
| Chalcopyrite, | $CuFeS_2$ |
| Covallite, | $CuS$ |
| Bornite, | $Cu_5FeS_4$ |
| Cubanite, | $Cu_2SFe_4S_5$ |
| Valerite, | $Cu_2Fe_4S_7$ or $Cu_3Fe_4S_7$ |

TABLE-continued

| | |
|---|---|
| Enargite, | $Cu_3(As,Sb)S_4$ |
| Tetrahedrite, | $Cu_3SbS_2$ |
| Tennanite, | $Cu_{12}As_4S_{13}$ |

Generally, the slurry will contain from about 5 to about 75 weight percent or more of one or more of the above described copper ores, usually in the range of about 10 to about 50 weight percent. The slurry will generally also contain mineral flotation or collecting agents, frothing agents, suppressants, stabilizers, and the like. For example, frothing agents which my be used in conjunction with the present invention in the slurry include polypropylene and polyethylene glycols and the corresponding methyl or ethyl ethers. In addition, isophorone, and methyl isobutyl carbinol could also be used. The slurry will also contain both of the above described mineral collecting agents when the present invention is used. The combined amount of collecting agents forming the mineral collector will usually be in the range from about 0.001 to about 1 pound of mineral collector per ton of ore, usually in the range of from about 0.005 to about 0.1 pounds of mineral collector per ton of ore. For ore concentrates, higher concentrations of mineral collector can be used if desired. Usually, the mercaptobenzothiazole and the hydrocarbyl trithiocarbonate will be present in the slurry together at a weight ratio in the range of from about 20:80 to about 80:20, most preferably at a weight ratio of about 1:1, since such a mineral collector has been used with good results.

In another aspect of the present invention, existing froth flotation processes employing 2-mercaptobenzothiazole for the recovery of copper values can proceed with higher efficiency when a hydrocarbyl trithiocarbonate is employed together with the 2-mercaptobenzothiazole. In accordance with the most preferred embodiment of the invention, the hydrocarbyl trithiocarbonate is employed in sufficient amount with the 2-mercaptobenzothiazole to result in higher copper values in the froth at the combined concentration of the 2-mercaptobenzothiazole and the hydrocarbyl trithiocarbonate than would be the case where the 2-mercaptobenzothiazole or the hydrocarbyl trithiocarbonate was used without the other at that concentration. Generally speaking, the process employing the 2-mercaptobenzothiazole can be improved by utilizing the hydrocarbyl trithiocarbonate in an amount in the range of from about $\frac{1}{4}$ to about 4 parts by weight for each part by weight of 2-mercaptobenzothiazole. More preferably, the hydrocarbyl trithiocarbonate is employed in an amount in the range of from about 0.5 to about 2 parts by weight per part by weight of the 2-mercaptobenzothiazole. In this embodiment, the combined concentration of the hydrocarbyl trithiocarbonate and the 2-mercaptobenzothiazole is sufficient to impart to the slurry in the range of from about 0.005 to about 0.1 pounds of flotation agent per ton of ore, where the 2-mercaptobenzothiazole and the hydrocarbyl trithiocarbonate are employed together at a weight ratio of about 1:1.

Any froth flotation apparatus can be used in this invention. The most commonly used commercial flotation machines are the Agitar (Galigher Co.), Denver D-2 (Denver Equipment Co.), and the Fagergren (Western Machinery Co.). The invention is illustrated by the following examples.

EXAMPLE I

This example is a control describing a standard ore flotation process wherein only one of the collectors, mercaptobenzothiazole, of the inventive 2-collector system is used. To a ball mill was charged 2000 grams of a copper-containing ore from Marcopper Ore, Philippines, along with 1300 milliliters of water and 1 gram (1 lb/ton) CaO. The mixture was ground for 8 minutes and transferred to a 10 Liter capacity Denver D-12 flotation cell. Also added to the cell was enough water to make a 9 percent aqueous slurry along with 6 drops of a frother, Dowfroth 250 and 2 milliliters (0.02 lb/ton) of a collector, 1 percent aqueous mercaptobenzothiazole the latter prepared by dissolving 1 gram of solid mercaptobenzothiazole in 99 milliliters of water containing 5 pellets (0.54 grams) of solid sodium hydroxide. The slurry was conditioned in the cell for 1 minute at 1400 rpm and floated for 3 minutes. The concentrate was filtered, dried and analyzed. The run was twice repeated to give percent recoveries of Cu 68.4, 55.8, and 57.6 for an average of 60.6 percent and percent recoveries of Fe as 12.4, 10.3, and 10.3 for an average of 11.0 percent.

EXAMPLE II

This example is also a control wherein the other collector sodium n-butyl trithiocarbonate, of the inventive 2-collector system is used. The procedure described in Example I was repeated except the mercaptobenzothiazole collector was replaced with 2 milliliters (0.02 lb/ton) of a 1 percent aqueous solution of sodium n-butyl trithiocarbonate. In addition, 12 drops of frother, Dowfroth 250, was used. The run was twice repeated to give percent recoveries of Cu 65.0, 66.4, and 68.9 for an average of 66.8 percent and percent recoveries of Fe as 13.2, 13.7 and 13.6 for an average of 13.5 percent. These values are slightly higher than those obtained in Example I.

EXAMPLE III

This example contains inventive runs illustrating that when the individual collectors, mercaptobenzothiazole (Example I) and sodium n-butyl trithiocarbonate (Example II) are preblended or added separately but used together as a collector, the blend or mixture gives a synergistic increase in the recovery of both Cu and Fe. The procedure described in Example II was repeated except the collector used was a premixed 1:1 weight ratio blend of the previously described 1 percent aqueous collector solution, mercaptobenzothiazole and sodium n-butyl trithiocarbonate. These results are listed in Table I along with those for the individual collectors from Examples I and II. This data shows that at equal concentrations (0.02 lb/ton), the inventive blend, Run No. 3, gives a significant increase in the amount of Cu and Fe recovered compared to the controls, Run, 1 and 2. The data also shows, the two collectors can be added separately but at the same place and time in the flotation (Run 4) and still give an increase in Cu and Fe recoveries.

TABLE I

Effect of Using Sodium n-Butyl Trithiocarbonate and Mercaptobenzothiazole Together as Cu and Fe Collectors in Ore Floatation 2000 g Ore (Marcopper Ore, Philippines)

| No. | Collector | lb/ton[a] | Rougher Concentrate, grams Total Wt. | Cu | Fe | Wt. % Recovery Cu | Fe |
|---|---|---|---|---|---|---|---|
| | | Control: | | | | | |
| 1. | Mercaptobenzothiazole[b] | 0.02 | 29.66 | 5.92 | 6.56 | 68.4 | 12.4 |
| | | | 26.51 | 5.43 | 5.71 | 55.8 | 10.3 |
| | | | 25.75 | 5.33 | 5.74 | 57.6 | 10.3 |
| | | | | | Average = | 60.6 | 11.0 |
| 2. | Sodium n-Butyl Trithiocarbonate[c] | 0.02 | 35.04 | 6.14 | 8.05 | 65.0 | 13.2 |
| | | | 33.07 | 6.17 | 7.25 | 66.4 | 13.7 |
| | | | 37.43 | 6.46 | 7.71 | 68.9 | 13.6 |
| | | | | | Average = | 66.8 | 13.5 |
| | | Invention: | | | | | |
| 3. | 1:1 Wt. Blend of | 0.02 | 39.23 | 6.71 | 9.42 | 71.1 | 17.3 |
| | Mercaptobenzothiazole | | 38.50 | 6.86 | 8.83 | 68.8 | 15.4 |
| | Sodium n-Butyl Trithiocarbonate | | 37.18 | 6.55 | 8.34 | 63.7 | 15.3 |
| | | | | | Average = | 67.9 | 16.0 |
| 4. | Mercaptobenzothiazole + | .01 | 37.24 | 6.56 | 8.45 | 69.2 | 15.9 |
| | Sodium n-Butyl Trithiocarbonate | .01 | 38.15 | 6.54 | 8.90 | 63.9 | 15.6 |
| | added separately but at the | | 42.07 | 6.78 | 9.37 | 72.9 | 17.5 |
| | same time and place. | | | | Average = | 68.7 | 16.3 |

[a]Dosage on a contained basis.
[b]1% Aq. Solution:1 g Mercaptobenzothiazole, 99 g $H_2O$, 5 pellets (0.54 grams) NaOH.
[c]1% Aq. Solution:2.5 g of 40% Aq. Solution sodium n-butyl trithiocarbonate and 97.5 g water.

That which is claimed:

1. In a process for the recovery of copper values from an ore containing same, wherein the values are recovered in a froth from an aqueous slurry containing the ore, wherein an aqueous alkaline solution of 2-mercaptobenzothiazole is employed as a mineral collector in the aqueous slurry to increase the copper values in the froth, the improvement comprising employing together with the aqueous alkaline solution of 2-mercaptobenzothiazole an aqueous solution of a hydrocarbyl trithiocarbonate represented by the formula:

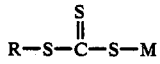

where R represents an alkyl or alkenyl group having from 2 to about 6 carbon atoms and M is selected from the group consisting of sodium and potassium, said 2-mercaptobenzothiazole and hydrocarbyl trithiocarbonate being present at a ratio and in a combined concentration sufficient to result in higher copper values in the froth than would be the case where the 2-mercaptobenzothiazole or the hydrocarbyl trithiocarbonate was used without the other at that concentration.

2. A process as in claim 1 wherein R comprises an alkyl group containing from about 2 to about 5 carbon atoms and M represents sodium.

3. A process as in claim 1 wherein the hydrocarbyl trithiocarbonate is employed in an amount in the range of about ¼ to about 4 parts by weight for each part by weight of 2-mercaptobenzothiazole.

4. A process as in claim 3 wherein the trithiocarbonate comprises sodium n-butyl trithiocarbonate.

5. A process as in claim 4 wherein the hydrocarbyl trithiocarbonate is employed in an amount in the range of about 0.5 to about 2 parts by weight per part by weight of 2-mercaptobenzothiazole.

6. A process as in claim 5 wherein the hydrocarbon trithiocarbonate and 2-mercaptobenzothiazole are preblended prior to addition to the slurry.

7. A process as in claim 5 wherein the hydrocarbyl trithiocarbonate and 2-mercaptobenzothiazole are added separately to the slurry.

8. A process as in claim 3 wherein the combined concentration of hydrocarbyl trithiocarbonate and 2-mercaptobenzothiazole is sufficient to impart to the slurry in the range of from about 0.005 to about 0.1 pounds of mineral collector per ton of ore.

9. A process as in claim 8 wherein the 2-mercaptobenzothiazole and the hydrocarbyl trithiocarbonate are employed together at a weight ratio of about 1:1.

10. In a process for the recovery of copper values from an ore containing copper, wherein the values are recovered in a froth from an aqueous slurry containing from about 5 to about 75 percent of copper containing ore, the improvement comprising employing an aqueous alkaline solution of a mercaptobenzothiazole represented by the formula:

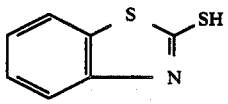

and an aqueous solution of a hydrocarbyl trithiocarbonate represented by the formula:

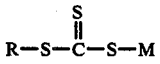

where R represents an alkyl or alkenyl radical which has from 2 to about 5 carbon atoms, and M is selected from the group consisting of a Group IA metal and ammonium cation, the mercaptobenzothiazole and the hydrocarbyl trithiocarbonate being present at a weight ratio in the range of about 20:80 to about 80:20 as a mineral sulfide collector in the aqueous slurry.

11. A process as in claim 10 wherein the slurry contains the mercaptobenzothiazole and the hydrocarbyl-trithiocarbonate combined in an amount in the range of from about 0.001 to about 1 pound of mineral collector per ton of ore.

12. A process as in claim 11 wherein the trithiocarbonate comprises sodium-n-butyl trithiocarbonate.

13. A process as in claim 12 wherein the mercaptobenzothiazole and the sodium-n-butyl trithiocarbonate are used together at a weight ratio of about 1:1 in an amount in the range of from about 0.005 to about 0.1 pound per ton of ore.

14. A composition comprising an aqueous alkaline solution of a mercaptobenzothiazole represented by the formula:

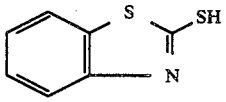

and an aqueous solution of a hydrocarbyl trithiocarbonate represented by the formula:

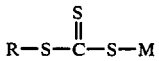

where R is an alkyl or alkenyl radical containing from 2 to about 6 carbon atoms and M is selected from the Group consisting of sodium and potassium and wherein the mercaptobenzothiazole and the hydrocarbyl trithiocarbonate are present at a weight ratio in the range of between about 20:80 and 80:20.

15. A composition as in claim 14 wherein the hydrocarbyl trithiocarbonate comprises sodium n-butyl trithiocarbonate.

16. A composition as in claim 15 further comprising, in the range of 0.1 to 50 parts by weight of blend per 100 parts by weight of water.

17. A composition as in claim 15 further characterized by containing at least one copper sulfide containing ore.

* * * * *